US011148386B2

(12) United States Patent
Totani et al.

(10) Patent No.: US 11,148,386 B2
(45) Date of Patent: Oct. 19, 2021

(54) PUNCHING UNIT AND MANUFACTURING APPARATUS FOR BAG HAVING RECLOSABLE TAPE

(71) Applicant: Totani Corporation, Kyoto (JP)

(72) Inventors: Mikio Totani, Kyoto (JP); Tomohiko Sembo, Kyoto (JP); Takahiro Motoda, Kyoto (JP)

(73) Assignee: Totani Corporation, Kyoto (JP)

( * ) Notice: Subject to any disclaimer, the term of this patent is extended or adjusted under 35 U.S.C. 154(b) by 209 days.

(21) Appl. No.: 16/479,504

(22) PCT Filed: Nov. 9, 2017

(86) PCT No.: PCT/JP2017/040462

§ 371 (c)(1),
(2) Date: Jul. 19, 2019

(87) PCT Pub. No.: WO2018/150658

PCT Pub. Date: Aug. 23, 2018

(65) Prior Publication Data

US 2019/0381754 A1 Dec. 19, 2019

(30) Foreign Application Priority Data

Feb. 20, 2017 (JP) ..... JP2017-028902

(51) Int. Cl.

| | |
|---|---|
| ***B31B 70/00*** | (2017.01) |
| ***B31B 70/14*** | (2017.01) |
| ***B31B 70/20*** | (2017.01) |
| ***B65D 33/25*** | (2006.01) |
| *B31B 160/10* | (2017.01) |

(52) U.S. Cl.

CPC ..... *B31B 70/006* (2017.08); *B31B 70/142* (2017.08); *B31B 70/20* (2017.08); *B65D 33/2508* (2013.01); *B31B 2160/102* (2017.08)

(58) Field of Classification Search

CPC .. B31B 1/22; B31B 1/90; B31B 23/14; B31B 70/006; B31B 70/20; B31B 70/142; B31B 2160/102; B65D 33/00; B65D 33/25

(Continued)

(56) References Cited

U.S. PATENT DOCUMENTS 4,488,466 A * 12/1984 Jones ..... B26D 1/085 225/105
5,114,394 A * 5/1992 Madsen ..... B26D 5/12 493/227

(Continued)

FOREIGN PATENT DOCUMENTS

EP 1889710 A1 2/2008
JP 2006110651 A * 4/2006 ..... B26D 7/26

(Continued)

OTHER PUBLICATIONS

Extended European Search Report dated Feb. 11, 2020 Jan. 16, 2018 by the European Patent Office (Munich, Germany) in corresponding European Application EP20170896600.8.

(Continued)

*Primary Examiner* — Valentin Neacsu
*Assistant Examiner* — Jacob A Smith
(74) *Attorney, Agent, or Firm* — NovoTechIP International PLLC

(57) ABSTRACT

Punched and incised portions can be formed properly, in which it is not necessary to replace an anvil depending on a type of a sheet material. A punching unit 51 comprises: a punching blade 50 for punching a first panel material 11, a second panel material 12, an open tape and a mounting base portion so as to form a punching portion; a incising portion 51 for incising the second panel material 12 and the mounting base portion disposed on the open tape so as to form a incising portion; and an adjusting portion 54 for adjusting a (Continued)

first gap 56 in a punching direction 5Z between edges 50A and 51A of the punching and incising blades 50 and 51.

20 Claims, 17 Drawing Sheets

(58) Field of Classification Search
USPC ..... 493/227
See application file for complete search history.

(56) References Cited

U.S. PATENT DOCUMENTS 7,080,585 B2 * 7/2006 Prudhomme ..... B26D 7/025 83/143
2006/0252621 A1 * 11/2006 Howell ..... B31B 70/00 493/13
2009/0050254 A1 * 2/2009 Goto ..... B65D 33/2533 156/66

FOREIGN PATENT DOCUMENTS

| | | | |
|---|---|---|---|
| JP | 2006110651 | A | 4/2006 |
| JP | 2014121751 | A | 7/2014 |
| WO | 2006112448 | A1 | 12/2008 |
| WO | 2016163349 | A1 | 10/2016 |

OTHER PUBLICATIONS

International Search Report and Written Opinion dated Jan. 16, 2018 by the International Searching Authority (Japan Patent Office) in PCT Application PCT/JP2017/040462.

* cited by examiner

PUNCHING UNIT AND MANUFACTURING APPARATUS FOR BAG HAVING RECLOSABLE TAPE

TECHNICAL FIELD

The invention relates to a punching unit and a manufacturing apparatus for a bag having a reclosable tape.

BACKGROUND

As a packaging material for seal-packaging various articles such as foods, pharmaceutical and medical products, electronic parts and stationeries, there has been used a bag having a reclosable tape, or a reclosable-tape-having bag, see for example Patent Document 1. Hereinafter, a conventional reclosable-tape-having bag and its manufacturing apparatus are explained with reference to Patent Document 1. Reference numbers described in Patent Document 1 are used for explaining the conventional reclosable-tape-having bag and its manufacturing apparatus as follows.

As shown in FIGS. 1 to 4, the reclosable-tape-having bag 1 includes first and second panel materials 11 and 12 which are superposed together and heat-sealed at its periphery. The first panel material 11 is further heat-sealed with a reclosable tape 20 having male and female fastener portions 21 and 22.

The reclosable-tape-having bag 1 further includes an open tape 23 so as to open the bag 1 easily. A tab (punched portion) 70 is formed as an opening trigger 30 by punching a side sealed portion 60 of the bag 1.

The open tape 23 is pulled upward together with the tab 70 so as to rip off the first panel material 11 and open the bag 1. The opened bag 1 can be reclosed and reopened using the reclosable tape 20.

The bag 1 further includes an incised portion 50 (50*a*, 50*b*) connected with the tab (punched portion) 70 so that both a mounting base portion 212 of the male fastener portion 21 and the second panel material 12 can be ripped off at the same time with a small force while pulling the tab 70 upward.

That is to say, the tab (punched portion) 70 is formed by punching the first panel material 11, the second panel material 12 and the mounting base portion 212 of the male fastener portion 21, while the incised portion 50 is formed by incising both the second panel material 12 and the mounting base portion 212 disposed on the open tape 23 and by not incising both the first panel material 11 and the open tape 23.

As shown in FIGS. 5 and 6 of Patent Document 1, the manufacturing apparatus for the reclosable-tape-having bag 1 includes a notch-forming machine 110. The notch-forming machine 110 includes Thomson blades 111 as notching blades, and an anvil 112 for receiving the blades 111. The Thomson blades 111 cuts the bag 1 from the second panel material 12 side. The anvil 112 is provided with a step for forming both the tab (punched portion) 70 and the incised portion 50.

There exist, however, several types of sheet materials such as the first and second panel materials 11 and 12. The proper anvil having the step has to be selected and replaced in accordance with the type of the sheet material because the amount of the depth of the incision formed by the Thomson blades 111 depends on the thickness, quality and so on of the sheet material. Thus, there is a problem in operation efficiency because it takes a long time to disassemble and suspend the manufacturing apparatus for replacing the proper anvil.

Patent Document 1: WO2006/112448

SUMMARY OF THE INVENTION

Problems to be Solved by the Invention

The present invention has been made in view of the above problem and it is an object of the present invention to provide a punching unit and a manufacturing apparatus for a reclosable-tape-having bag, which are capable of forming a punched portion and an incised portion properly, in which it is not necessary to select and replace an anvil depending on a type of a sheet material.

Solution to the Problems

In order to achieve the object, the present invention provides a punching unit for forming a tab on a reclosable-tape-having bag.

The bag comprises:

- a first panel material;
- a second panel material superposed on the first panel material, the first and second panel materials being attached together at peripheries thereof;
- a reclosable tape disposed between the first and second panel materials, the reclosable tape including male and female fastener portions; and
- an open tape disposed between a mounting base portion of the male or female fastener portion and the first panel material so as to rip off the first panel material.

The punching unit comprises:

- a punching blade configured to punch the first panel material, the second panel material, the open tape and the mounting base material so as to form a punched portion;
- an incising blade configured to incise the second panel material and the mounting base portion disposed on the open tape so as to form an incised portion; and
- an adjusting mechanism configured to adjust a first gap disposed in a punching direction and between edges of the punching and incising blades.

The adjusting mechanism comprises a bolt for pressing the punching or incising blade so that the first gap is adjusted by rotating the bolt.

The bolt comprises a knob for rotating the bolt.

The knob comprises a scale for indicating an amount of a rotation of the bolt.

In order to achieve the object, the present invention also provides a punching unit for forming a tab on a reclosable-tape-having bag.

The bag comprises:

- a first panel material;
- a second panel material superposed on the first panel material, the first and second panel materials being attached together at peripheries thereof;
- a reclosable tape disposed between the first and second panel materials, the reclosable tape including male and female fastener portions; and
- an open tape disposed between a mounting base portion of the male or female fastener portion and the first panel material so as to rip off the first panel material.

The punching unit comprises:

- a punching blade configured to punch the first panel material, the second panel material, the open tape and the mounting base material so as to form a punched portion;

an incising blade configured to incise the second panel material and the mounting base portion disposed on the open tape so as to form an incised portion; and an adjusting mechanism configured to adjust a first gap disposed in a punching direction and between edges of the punching and incising blades.

The adjusting mechanism comprises a bolt for pressing the punching or incising blade so that the first gap is adjusted by rotating the bolt.

The adjusting mechanism comprises a switching portion for switching between movable and immovable states of a rotation of the bolt.

According to a preferable embodiment of the punching unit, wherein the adjusting mechanism comprises a press portion for pressing and abutting the punching or incising blade against the bolt 540.

According to a preferable embodiment of the punching unit, wherein the adjusting mechanism is configured to move the incising blade relative to the punching blade.

According to a preferable embodiment of the punching unit, wherein the adjusting mechanism comprises a rail for sliding the incising blade relative to the punching blade.

According to a preferable embodiment of the punching unit, wherein the rail is mounted on the punching or incising blade.

In order to achieve the object, the present invention also provides a manufacturing apparatus for manufacturing a reclosable-tape-having bag.

The bag comprises:

a first panel material;

a second panel material superposed on the first panel material, the first and second panel materials being attached together at peripheries thereof;

a reclosable tape disposed between the first and second panel materials, the reclosable tape including male and female fastener portions; and an open tape disposed between a mounting base portion of the male or female fastener portion and the first panel material so as to rip off the first panel material.

The punching unit comprises:

a punching blade configured to punch the first panel material, the second panel material, the open tape and the mounting base material so as to form a punched portion;

an incising blade configured to incise the second panel material and the mounting base portion disposed on the open tape so as to form an incised portion; and an adjusting mechanism configured to adjust a first gap disposed in a punching direction and between edges of the punching and incising blades.

The adjusting mechanism comprises a bolt for pressing the punching or incising blade so that the first gap is adjusted by rotating the bolt.

The bolt comprises a knob for rotating the bolt.

The knob comprises a scale for indicating an amount of a rotation of the bolt.

In order to achieve the object, the present invention also provides a manufacturing apparatus for manufacturing a reclosable-tape-having bag.

The bag comprises:

a first panel material;

a second panel material superposed on the first panel material, the first and second panel materials being attached together at peripheries thereof;

a reclosable tape disposed between the first and second panel materials, the reclosable tape including male and female fastener portions; and an open tape disposed between a mounting base portion of the male or female fastener portion and the first panel material so as to rip off the first panel material.

The punching unit comprises:

a punching blade configured to punch the first panel material, the second panel material, the open tape and the mounting base material so as to form a punched portion;

an incising blade configured to incise the second panel material and the mounting base portion disposed on the open tape so as to form an incised portion; and an adjusting mechanism configured to adjust a first gap disposed in a punching direction and between edges of the punching and incising blades.

The adjusting mechanism comprises a bolt for pressing the punching or incising blade so that the first gap is adjusted by rotating the bolt.

The adjusting mechanism comprises a switching portion for switching between movable and immovable states of a rotation of the bolt.

Effect of the Invention

The punching unit and the manufacturing apparatus for the reclosable-tape-having bag are capable of forming the punched portion and the incised portion properly, in which it is not necessary to replace the anvil depending on the type of the sheet material.

DETAILED EXPLANATION OF THE PREFERRED EMBODIMENTS

A punching unit, a manufacturing apparatus and a manufacturing method for a bag with a reclosable tape (reclosable-tape-having bag) according to the present invention will be explained below with reference to the drawings.

A First Embodiment of the Reclosable-Tape-Having Bag

The first embodiment of the reclosable-tape-having bag 1 will be explained with reference to FIGS. 1 to 6. A width direction X, a longitudinal direction Y and a thickness direction Z are at right angles to each other.

Figure 1:
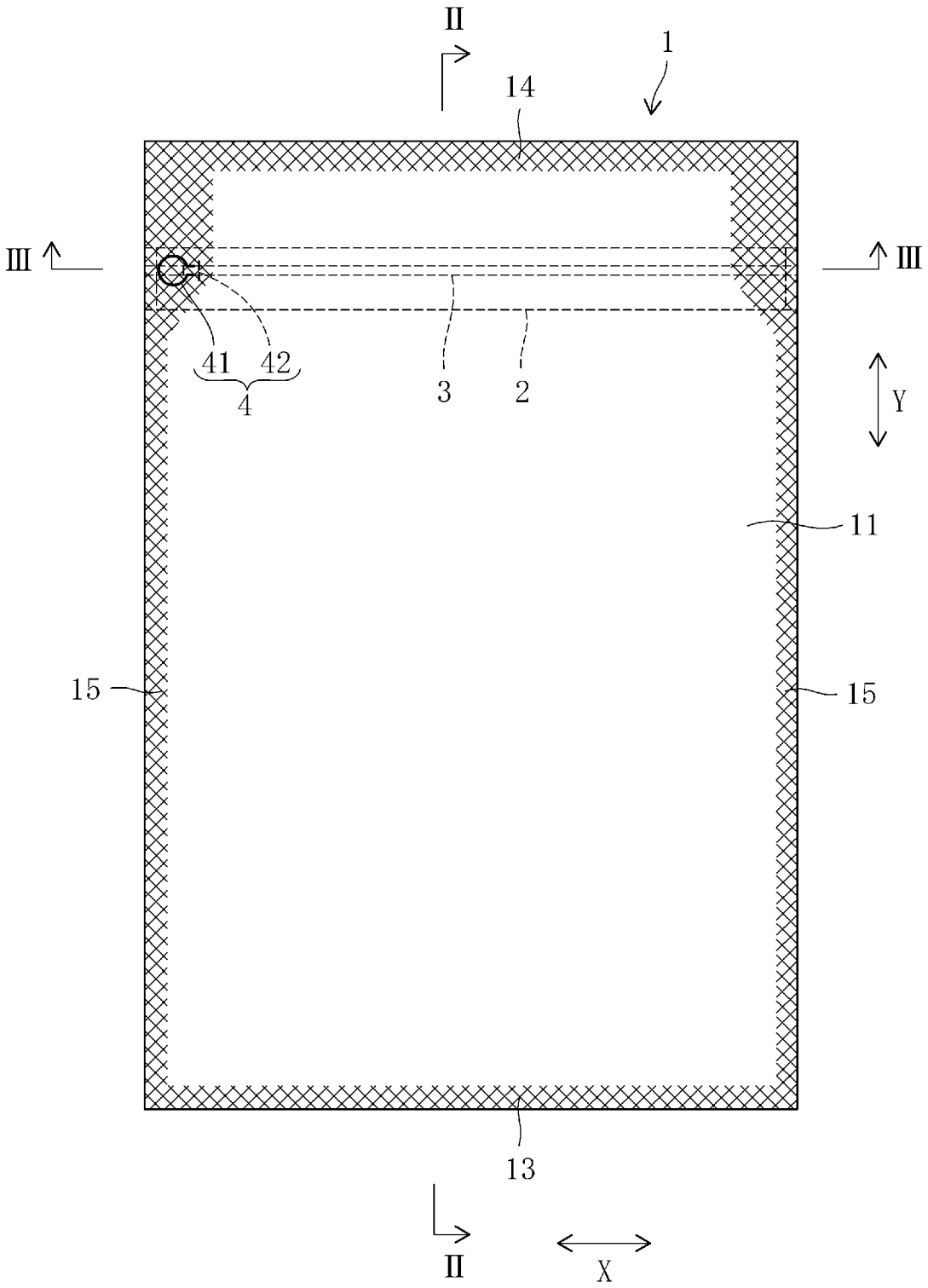
FIG. 1 is a front view showing a first embodiment of a reclosable-tape-having bag.
Figure 2:
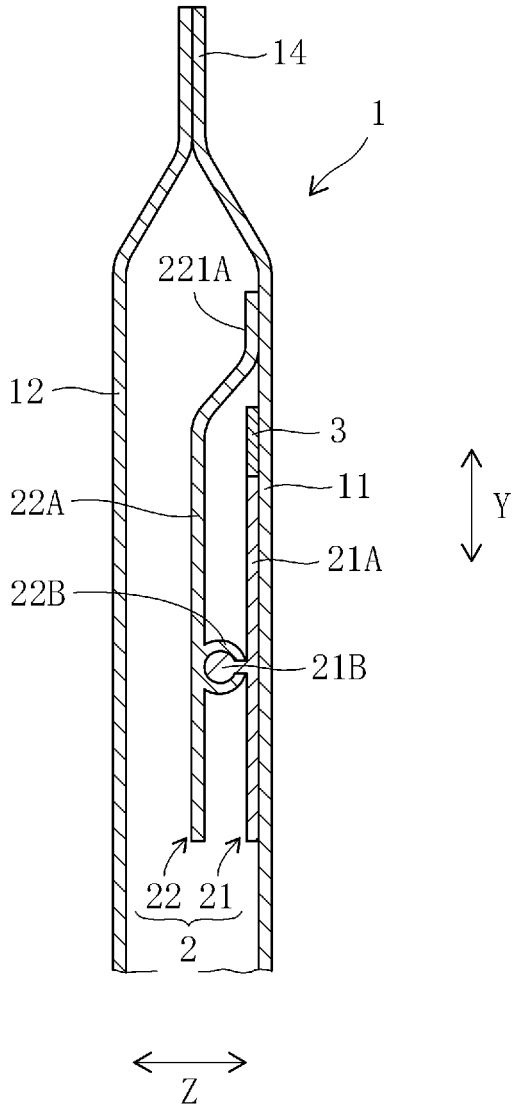
FIG. 2 is a partially cross-sectional view taken along line II-II in FIG. 1.
Figure 3:
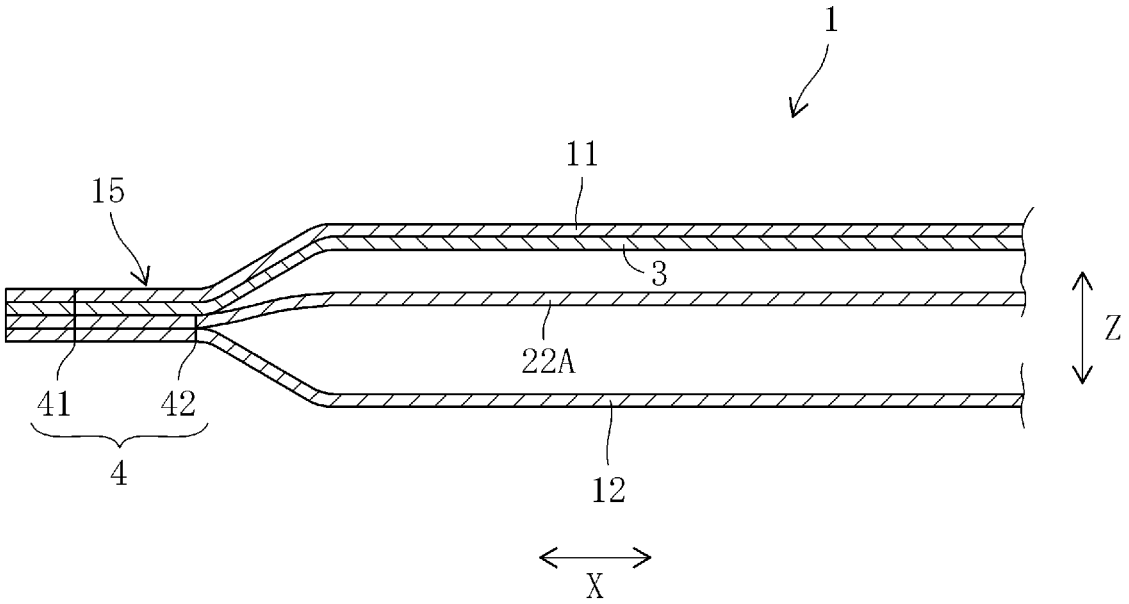
FIG. 3 is a partially cross-sectional view taken along line in FIG. 1.

As shown in FIG. 1, the bag 1 includes first and second rectangular panel materials 11 and 12 (FIGS. 2 and 3). The first and second panel materials 11 and 12 are made from plastic films. The first and second panel materials 11 and 12 are superposed together and heat-sealed at its peripheries 13, 14 and 15.

The first and second panel materials 11 and 12 includes a bottom sealed portion 13 and a top sealed portion 14 in parallel to the width direction X, and a pair of side sealed portions 15 and 15 in parallel to the longitudinal direction Y. Each of the sealed portions 13, 14 and 15 is formed by heat-sealing the peripheries of the first and second panel materials 11 and 12.

The bag 1 further includes a reclosable tape 2 and an open tape 3 each of which are extended in the width direction X and disposed on the top sealed portion 14 side.

As shown in FIG. 2, the reclosable tape 2 is disposed between the first and second panel materials 11 and 12. The reclosable tape 2 includes a male fastener portion and a female fastener portion 22. The male and female fastener portions 21 and 22 are extended in the width direction X.

The male fastener portion 21 includes a mounting base portion 21A and a convex portion 21B. The female fastener portion 22 includes a mounting base portion 22A and a concave portion 22B. The convex and concave portions 21B and 22B are opposed to each other in the thickness direction Z. The convex and concave portions 21B and 22B are made of elastically deformable material, such as synthetic resin, so as to be capable of being engaged with and separated from each other.

The mounting base portion 21A of the male fastener portion 21 is heat sealed with the first panel material 11. An end portion 221A of the mounting base portion 22A of the female fastener portion 22 is heat-sealed with the first panel material 11 and between the top sealed portion 14 and the mounting base portion 21A of the male fastener portion 21.

The whole surface of the open tape 3 is heat-sealed with the first panel material 11. The open tape 3 is disposed between the mounting base portion 21A of the male fastener portion 21 and the end portion 221A of the mounting base portion 22A of the female fastener portion 22.

As shown in FIG. 1, the bag 1 includes a tab 4 that is disposed on one side of the width direction X of the bag 1. The tab 4 includes a punched portion 41 and an incised portion 42. The tab 4 is mounted on the side sealed portion 15.

The punched portion 41 is shaped like a "C" shape in a plan view so that the open tape 3 is disposed on the open portion of the "C" shape. The incised portion 42 is shaped like a straight-line shape extending in the longitudinal direction Y and across the open tape 3. Positional relations of the male and female fastener portions 21 and 22 may be reversed.

As shown in FIG. 3, the punched portion 41 is formed by punching the first panel portion 11, the second panel portion 12, the open tape 3 and the mounting base portion 22A of the male fastener portion 22. On the other hand, the incised portion 42 is formed by incising the second panel material 12 and the mounting base portion 22A disposed on the open tape 3 and by not incising the first panel material 11 and the open tape 3.

[A Process of Opening the Reclosable-Tape-Having Bag]

The process of opening the reclosable-tape-having bag 1 will be explained with reference to FIGS. 4 to 6.

Figure 4:
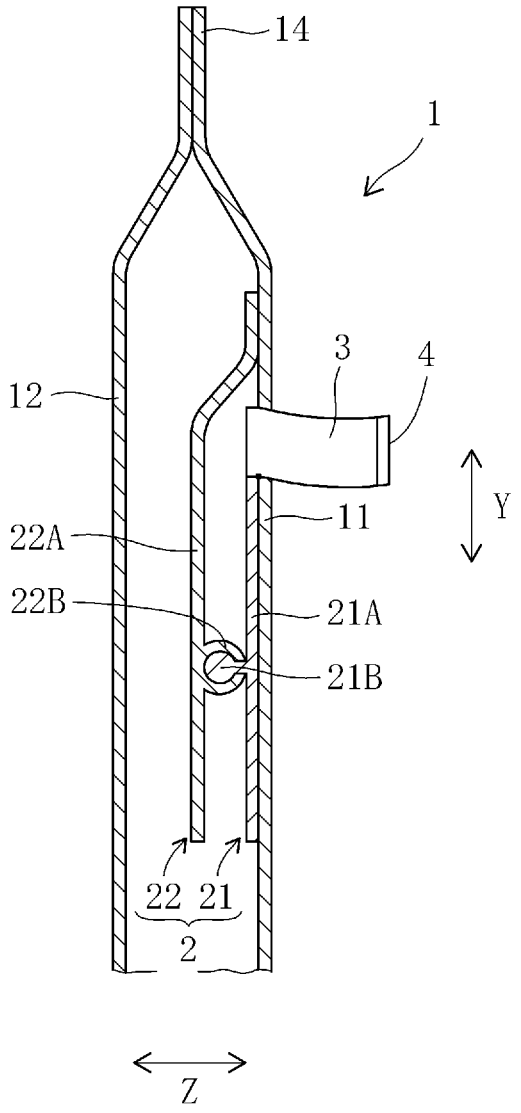
FIG. 4 is a partially cross-sectional view taken along line II-II in FIG. 1 showing the first embodiment of the reclosable-tape-having bag, in which an open tape is pulled upward together with a tab.
Figure 5A:
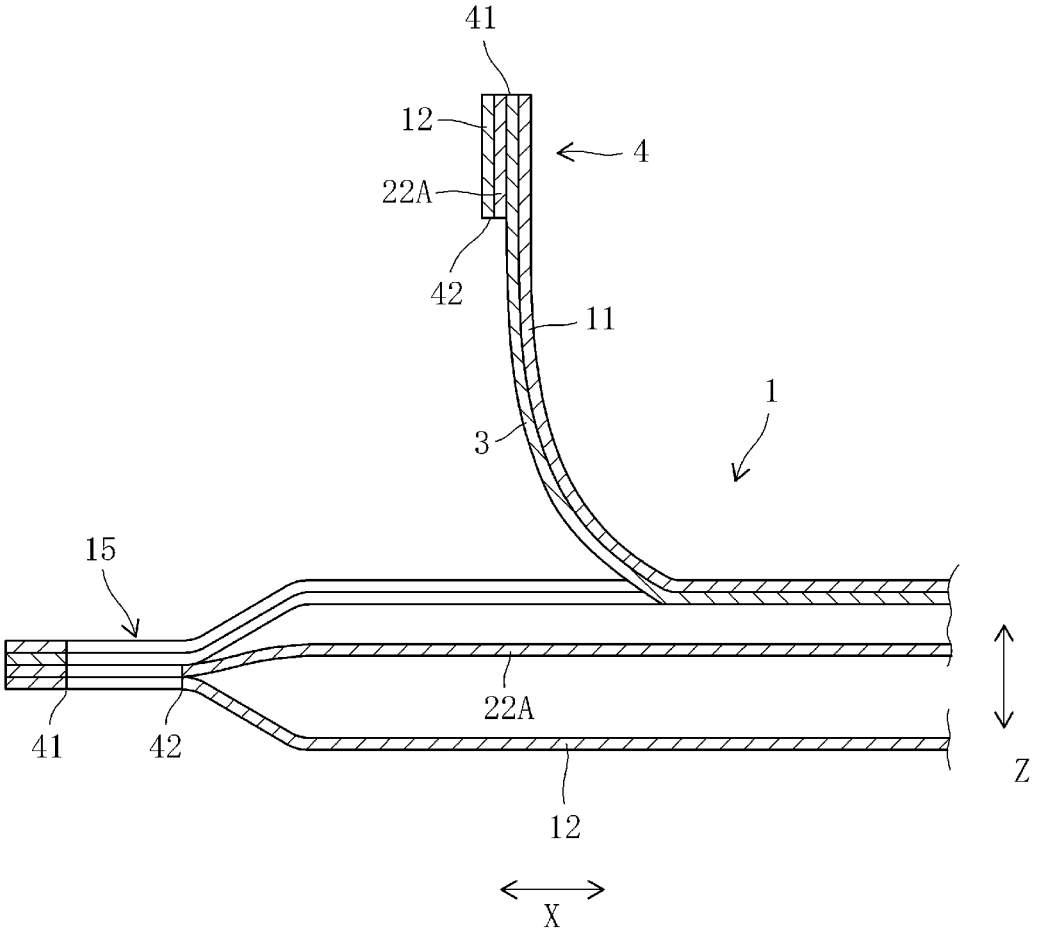
FIG. 5A is a partially cross-sectional view taken along line in FIG. 1 showing the first embodiment of the reclosable-tape-having bag, in which the open tape is pulled upward together with the tab.

As shown in FIGS. 4 and 5, the tab 4 is pulled upward in the thickness direction Z. At that time, the first panel material 11, the second panel material 12, the open tape 3 and the mounting base portion 22A of the female fastener portion 22 are ripped off by the punched portion 41. Further, the mounting base portion 22A of the female fastener portion 22 and the second panel portion 12 are ripped off by the incised portion 42.

Figure 5B:
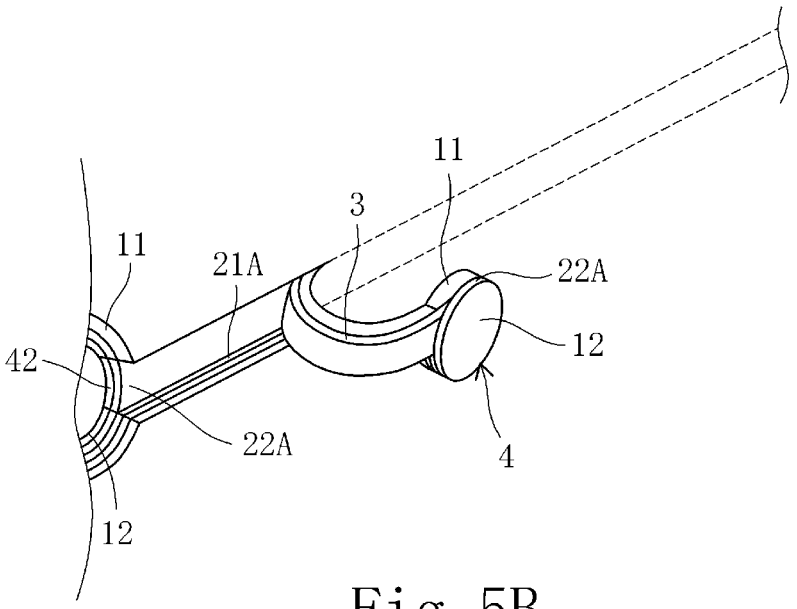
FIG. 5B is a perspective view showing the first embodiment of the reclosable-tape-having bag, in which the open tape is pulled upward together with the tab.
Figure 6:
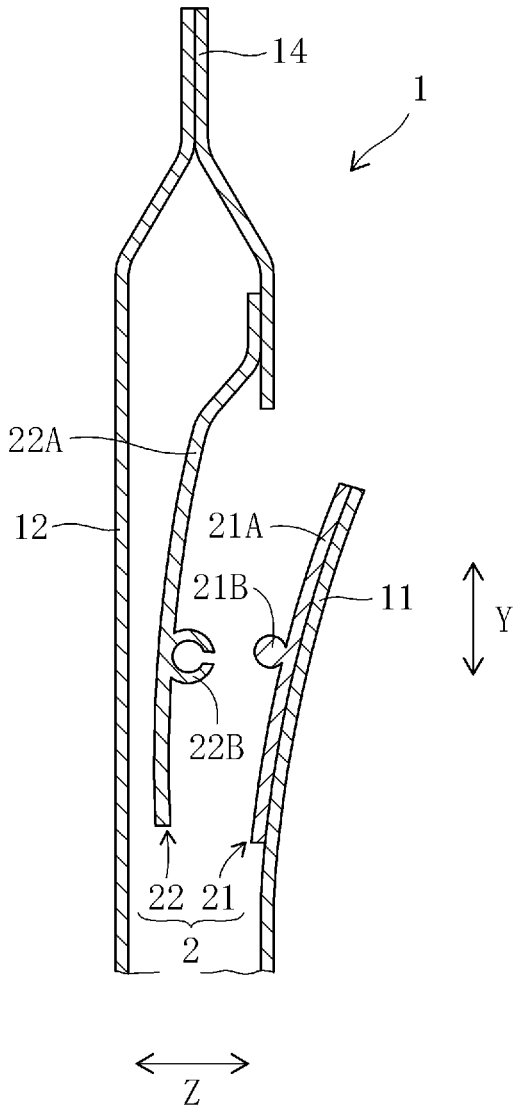
FIG. 6 is a partially cross-sectional view taken along line II-II in FIG. 1, in which a reclosable tape of the reclosable-tape-having bag is opened.

As shown in FIG. 5B, the open tape 3 is pulled upward together with the tab 4 so as to rip off the first panel material 11 disposed on the open tape 3 when opening the bag 1. As shown in FIG. 6, the opened bag 1 can be reclosed and reopen by the male and female fastener portions 21 and 22 of the reclosable tape 2 which are capable of being engaged with and separated from each other.

[A Manufacturing Apparatus and Method for the Reclosable-Tape-Having Bag]

Figure 7:
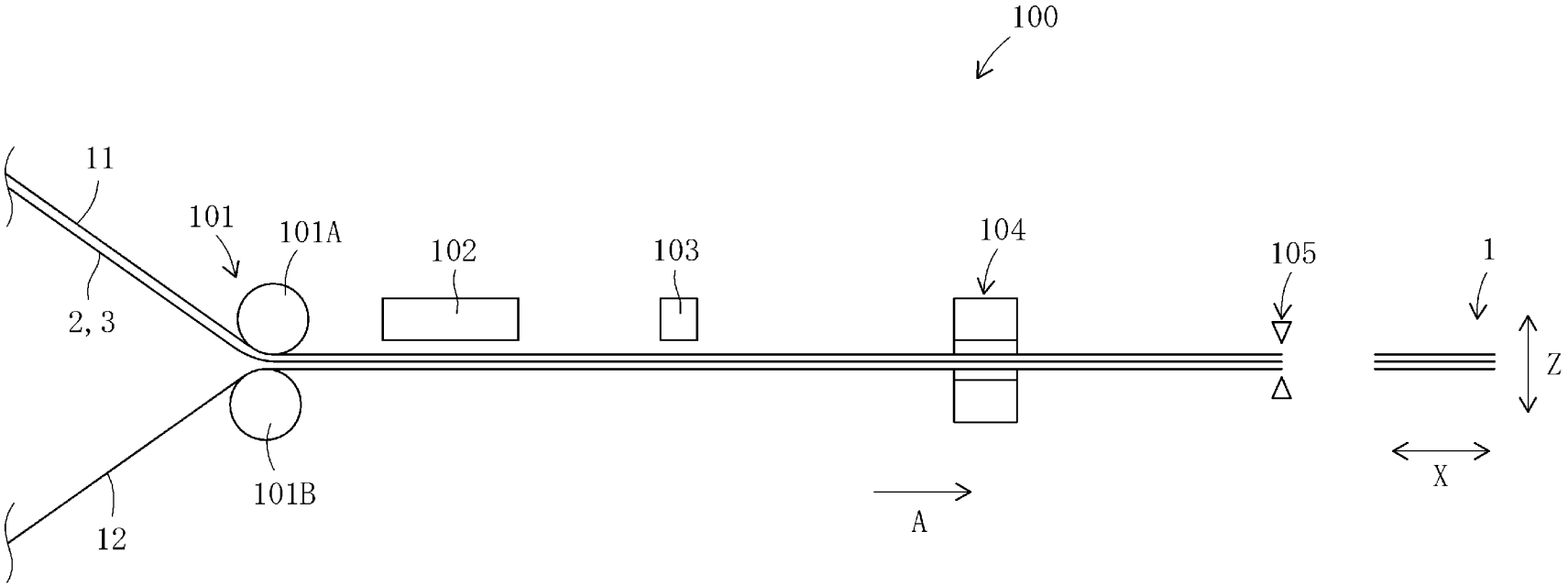
FIG. 7 is a side view showing a manufacturing apparatus for the reclosable-tape-having bag.
Figure 8:
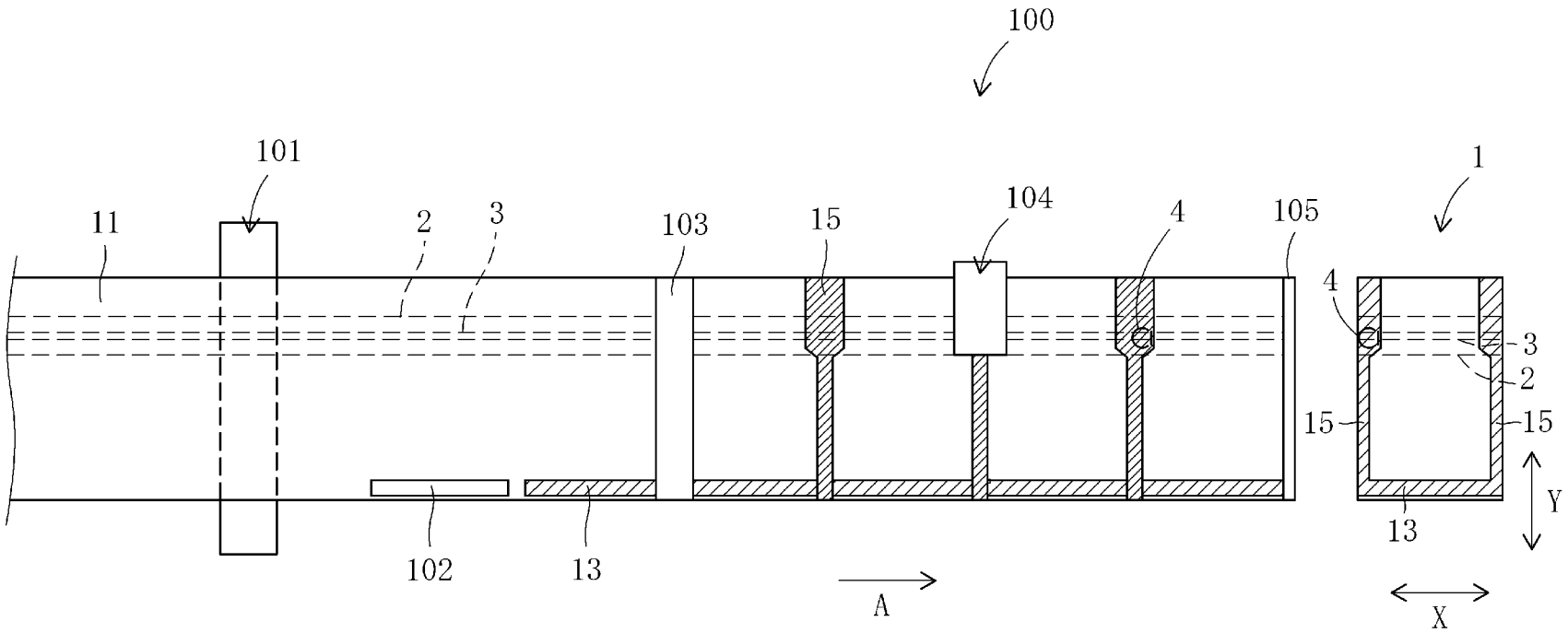
FIG. 8 is a plan view of FIG. 7.

The manufacturing apparatus and method for the reclosable-tape-having bag 1 will be explained with reference to FIGS. 7 and 8.

The manufacturing apparatus 100 includes a guide portion 101 including a pair of guide rollers 101A and 101B, a longitudinal heat-seal bar 102, a cross heat-seal bar 103, a tab forming portion 104 and a cross cutter 105.

The elongated first panel material 11, the elongated reclosable tape 2, the elongated open tape 3 and the elongated second panel material 12 are fed in a feed direction A by the guide portion 101. The feed direction A is parallel to the width direction X of the bag 1. The first and second panel materials 11 and 12 are fed by the guide portion 101. The reclosable tape 2 and the open tape 3 are heat-sealed with the fed first panel material 11. The first and second panel materials 11 and 12 are fed intermittently, and stop-and-go are repeated every predetermined time.

The first and second panel materials 11 and 12 are superposed with each other via the reclosable tape 2 and the open tape 3 by the guide portion 101. The bottom sealed portion 13 is formed by the longitudinal heat seal bar 102 and the side sealed portions 15 are formed by the cross heat seal bar 103 while the fed first and second panel materials 11 and 12 are stopped.

The tab 4 is also formed by the tab forming portion 104 while the fed first and second panel materials 11 and 12 are stopped. The first and second panel materials 11 and 12 and so on are cut by the cross cutter 105 in the longitudinal direction Y while the fed first and second panel materials 11 and 12 are stopped. As a result, the bag 1 is manufactured, but the top sealed portion 14 has not yet been formed.

That is to say, the manufactured bag 1 is opened at a position to be provided with the top sealed portion 14. Various articles (not shown) such as foods, pharmaceutical and medical products, electronic parts and stationeries are put into the opened bag 1. The articles cannot be caught in the reclosable tape 2 because the male and female fastener portions 21 and 22 of the reclosable tape 21 are engaged with each other while the articles are being put into the bag 1. The bag 1 filled with the articles includes the top sealed portion 14 formed by an additional heat seal bar (not shown). The bag 1 filled with the articles is therefore manufactured. The feed direction A is not limited to a direction parallel to the width direction X of the bag 1. The feed direction A can be parallel to a height direction Y (longitudinal direction Y of the bag 1) by a known method for inserting the reclosable tape 2 and the open tape 3.

[A Punching Unit]

The punching unit 5 will be explained with reference to FIGS. 9 to 13.

Figure 9A:
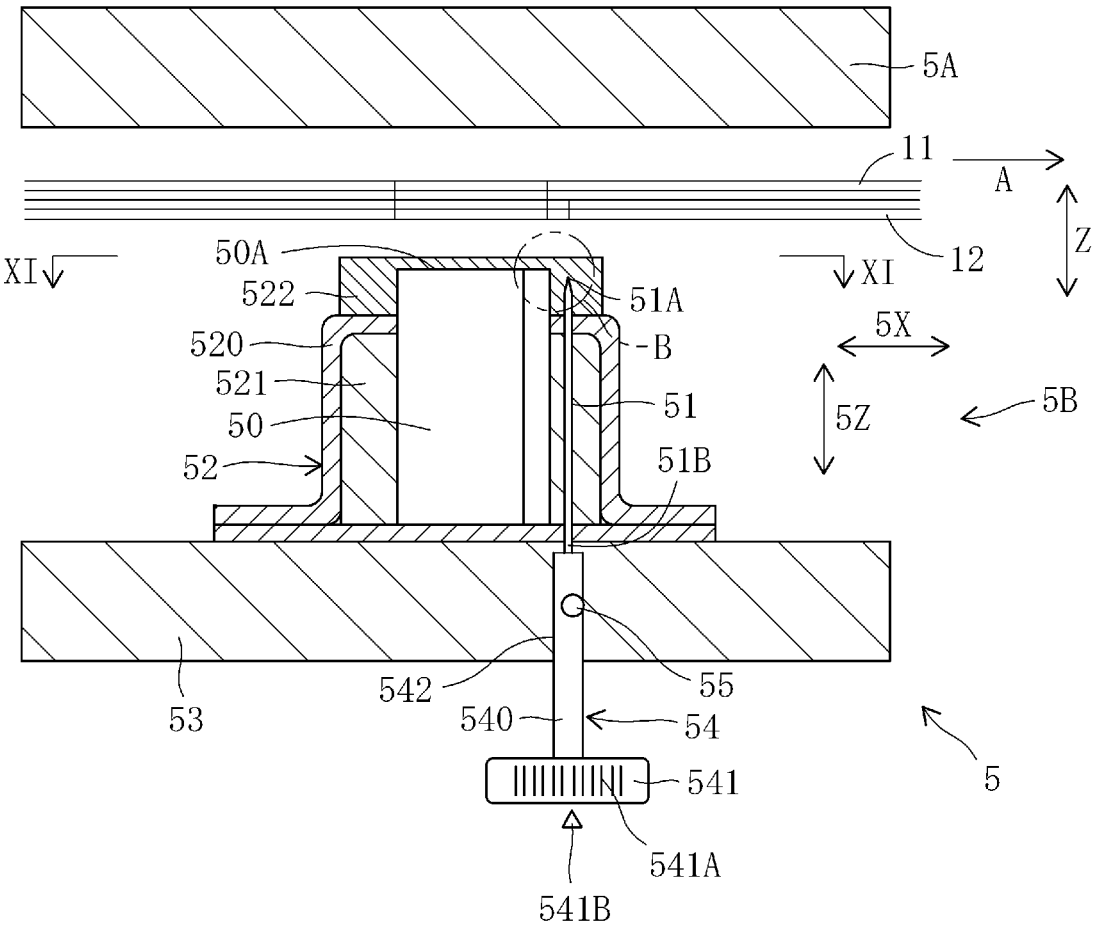
FIG. 9A is a partially cross-sectional side view showing a punching unit.

The tab forming portion 104 includes the punching unit 5. As shown in FIG. 9, the punching unit 5 includes first and second units 5A and 5B. The first unit 5A faces to the first panel material 11, while the second unit 5B faces to the second panel material 12.

Figure 10:
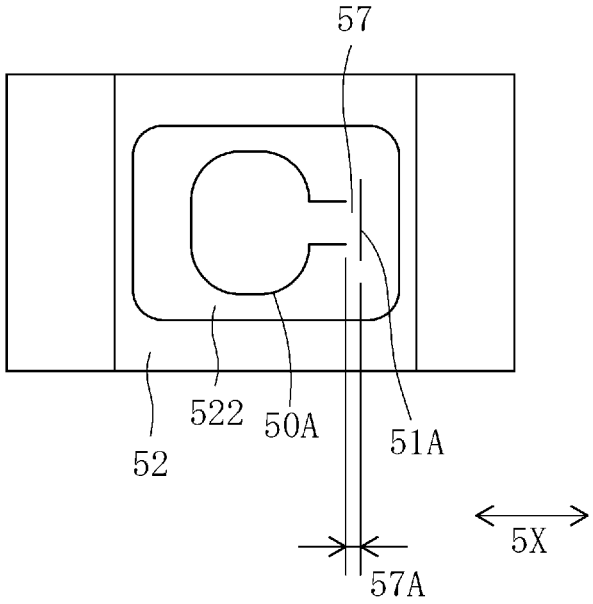
FIG. 10 is a view in a direction toward line XI-XI in FIG. 9.

The second unit 5B includes a punching blade 50 and an incising blade 51. The punching blade 50 is configured to form the punched portion 41 of the tab 4. The incising blade 51 is configured to form the incised portion 42 of the tab 4. Therefore, as shown in FIG. 10, an edge 50A of the punching blade 50 is shaped like the "C" shape in the plan view, similar to the punched portion 41. The edge 51A of the incising blade 51 is shaped like the straight-line shape, similar to the incised portion 42.

The punching blade 50 and the incising blade 51 are supported by a supporting portion 52. The second unit 5B includes a base portion 53 for holding the supporting portion 52. The base portion 53 is configured to be retractably movable in a punching direction 5Z. The punching direction 5Z is approximately parallel to the thickness direction Z.

The supporting portion 52 includes a frame portion 520 and a regulating portion 521. The frame portion 520 is configured to hold the punching blade 50. The frame portion 520 is, for example, made of metal. The regulating portion 521 is configured to regulate the movement of the punching blade 50 and the incising blade 51 in a direction 5X or 5Y right-angled to the punching direction 5Z. The regulating portion 521 is made of such as wood.

The second unit 5B includes an adjusting mechanism 54. The adjusting mechanism 54 includes a bolt 540, and a knob 541 mounted on a top portion of the bolt 540. The bolt 540 is engaged with a screw hole 542 formed in the base portion 53. The screw hole 542 extends in the punching direction 5Z. Thus, the bolt 540 is retractably movable in the punching direction 5Z by its rotation. The adjusting mechanism 54 can make a micro adjustment in case that the bolt 540 and the screw hole 542 have fine screw threads.

Figure 11:
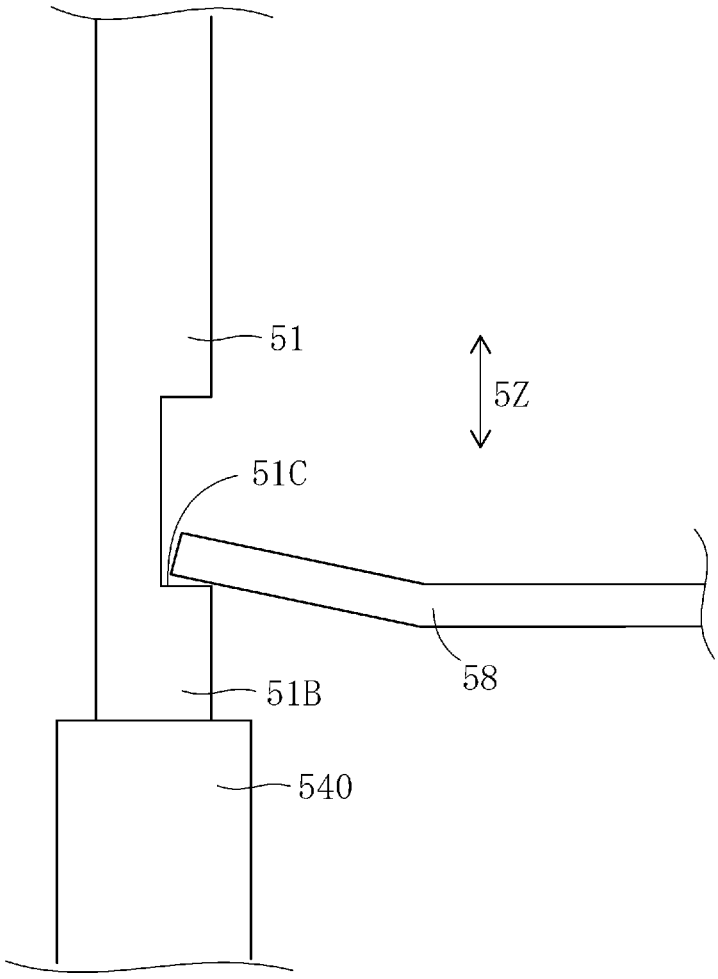
FIG. 11 is a partially enlarged view showing a pressing portion.

The punching blade 50 and the incising blade 51 are supported on the supporting portion 52 in such a way that the punching blade 50 is immovable and the incising blade 51 is movable in the punching direction 5Z. As shown in FIG. 11, the second unit 5B includes a pressing portion 58. The pressing portion 58 is, for example, constituted of a leaf spring. The incising blade 51 includes an engaged portion 51*c*. The engaged portion 51*c* is engaged with the pressing portion 58. The pressing portion 58 presses the incising blade 51 so that a base portion 51B of the incising blade 51 is constantly contact with an edge of the bolt 540.

Figure 9B:
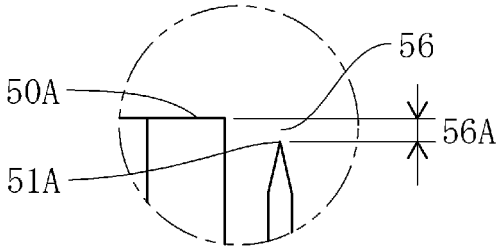
FIG. 9B is an enlarged view showing a B portion in FIG. 9A.

Thus, the base portion 51B presses the edge of the bolt 540 constantly. As shown in FIG. 9, the incising blade is retractably movable in the punching direction 5Z according to clockwise and counterclockwise rotations of the bolt 540. As shown in FIG. 9B, a first gap 56 is formed in the punching direction 5Z and between the edges 50A and 51A of the punching and incising blades 50 and 51. A distance 56A of the first gap 56 can be adjusted according to the amount of the rotation of the bolt 540.

The knob 541 has a scale 541A for indicating the amount of the rotation of the bolt 540. An adjusting mark 541B is held on a frame (not shown) of the manufacturing apparatus. Thus, an operator can make a micro adjustment for the amount of the rotation of the bolt 540 by identifying positional relations of the scale 541A and the adjusting mark 541B.

The second unit 5B includes a switching portion 55 for switching between the movable and immovable states of the rotation of the bolt 540. The switching portion 55 is, for example, constituted of a setscrew. The switching portion 55 is mounted on the base portion 53. The switching portion 55 can allow the bolt 540 to be rotatable by not pressing the bolt 540, while the switching portion 55 can further keep the bolt 540 from being rotatable by pressing the bolt 540.

As shown in FIG. 10, a second gap 57 is formed in the direction 5X right-angled to the punching direction 5Z and between the edge 50A of the punching blade 50 and the edge 51A of the incising blade 51. A distance of the second gap 57 is, for example, about 0.5 mm. Thus, the punched portion 41 of the tab 4 is not contact with the incised portion 42 thereof. In the case of the first embodiment of the bag 1, there is not a problem even if the punched portion 41 is contact with the incised portion 42. However, in the case of the second embodiment of the bag 1, it is necessary that the punched portion 41 is not contact with the incised portion 42 as follows.

As shown in FIG. 9, the punching unit 5 includes the first unit 5A. The first unit 5A is constituted of an anvil for receiving the punching and incising blades 50 and 51 of the second unit 5B. The anvil 5A has a flat surface for receiving the edges 50A and 51A of both the punching and incising blades 50 and 51, and further the surface being parallel to the direction 5X (feed direction A).

[A Process of Forming the Tab]

The process of forming the tab 4 with the punching unit 5 will be explained.

The base portion 53 is on standby at a position (standby position) where the edges 50A and 51A of both the punching and incising blades 50 and 51 are away from the fed first and second panel materials 11 and 12. When the fed first and second panel materials 11 and 12 stop between the first and second units 5A and 5B of the punching unit 5, the base portion 53 moves in the punching direction 5Z and toward a position (punching position) where the edges 50A and 51A of both the punching and incising blades 50 and 51 abut against the first and second panel materials 11 and 12.

At first, an elastic portion 522 to be described later presses the plastic films (first and second panel materials 11 and 12 and so on) on the anvil 5A, which is compressed and deformed, so as to keep the plastic films from being movable on the anvil 5A. The edge 50A of the punching blade 50 punches the first panel portion 11, the second panel portion 12, the open tape 3 and the mounting base portion 22A of the male fastener portion 22 so as to form the punched portion 41. On the other hand, the edge 51A of the incising blade 51A incises the second panel material 12 and the mounting base portion 22A disposed on the open tape 3, and which does not incise the first panel material 11 and the open tape 3, so that the incised portion 42 is formed.

Therefore, the first gap 56 can be adjusted by the adjusting mechanism 56 so as to form the punched and incised portions 41 and 42 properly, in which it is not necessary to replace the anvil depending on the type of the sheet material, such as the first panel material 11, the second panel material 12, the open tape 3 and the mounting base portion 22A of the female fastener portion 22.

The base portion 53 returns to the standby position after forming the tab 4. The second unit 5B includes the elastic portion 522 for making the punched and incised blades 50 and 51 be away from the first and second panel materials 11 and 12 with certainty at that time. The elastic portion 522 is, for example, made from a sponge.

The elastic portion 522 projects from each of the edges 50A and 51A in the punching direction 5Z when the edges 50A and 51A of the punching and incising blades 50 and 51 are away from the first and second panel materials 11 and 12. On the other hand, the elastic portion 522 is pressed from each of the edges 50A and 51A in the punching direction 5Z when the edges 50A and 51A of the punching and incising blades 50 and 51 abut against the first and second panel materials 11 and 12.

Thus, the elastic portion 522 presses the first and second panel materials 11 and 12 so that each of the edges 50A and 51A is away from the first and second panel materials 11 and 12 with certainty when the base portion 53 moves from the punching position to the standby position.

A Second Embodiment of the Punching and Incising Blades

Figure 12A:
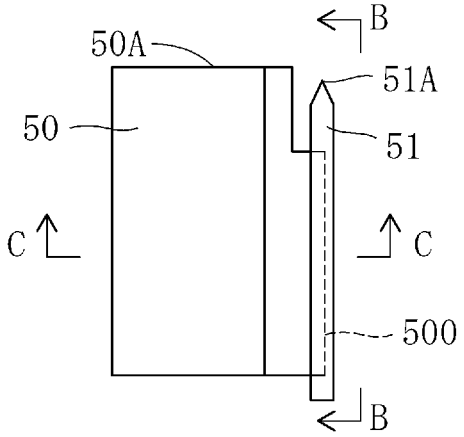
FIG. 12A is a side view showing a second embodiment of a punching blade and an incising blade.
Figure 12B:
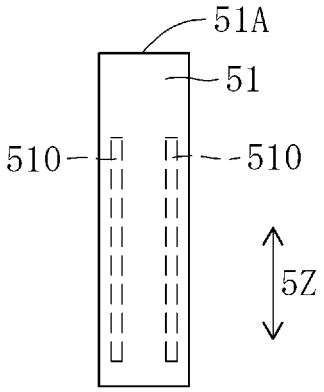
FIG. 12B is a view in a direction toward line B-B in FIG. 12A.
Figure 12C:
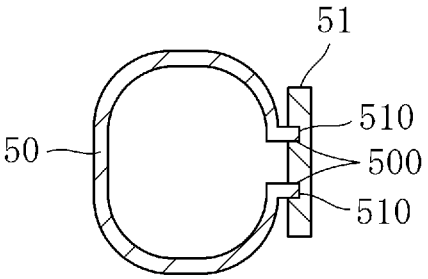
FIG. 12C is a view in a direction toward line C-C in FIG. 12A.

The second embodiment of the punching and incising blades 50 and 51 will be explained with reference to FIG. 12.

The punching blade 50 includes a pair of rails 500 and 500 for sliding the incising blade 51. The incising blade 51 includes a pair of grooves 510 and 510 fitted into each of the rails 500. The rails 500 and the grooves 510 are extended in the punching direction 5Z. Thus, the incising blade 51 can move relative to the punching blade 50 and in parallel to the punching direction 5Z with certainty.

A Third Embodiment of the Punching and Incising Blades

Figure 13A:
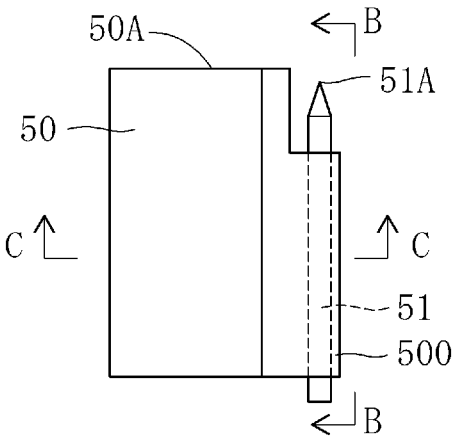
FIG. 13A is a side view showing a third embodiment of the punching blade and the incising blade.
Figure 13B:
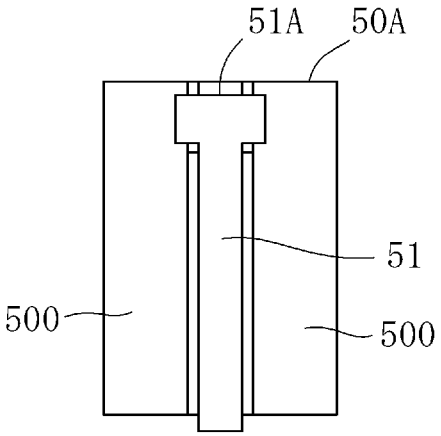
FIG. 13B is a view in a direction toward line B-B in FIG. 13A.
Figure 13C:
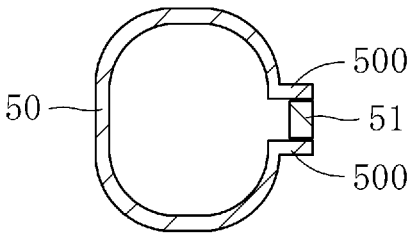
FIG. 13C is a view in a direction toward line C-C in FIG. 13A.

The third embodiment of the punching and incising blades 50 and 51 will be explained with reference to FIG. 13.

The punching blade 50 includes a pair of rails 500 and 500 for sliding the incising blade 51. The incising blade 51 is nipped between the rails 500. The rails 500 are extended in the punching direction 5Z. Thus, the punching blade 51 can move relative to the incising blade 50 and in parallel to the punching direction 5Z with certainty.

A Second Embodiment of the Reclosable-Tape-Having Bag

The second embodiment of the reclosable-tape-having bag 1 will be explained with reference to FIGS. 14 to 17. Detailed explanation about the same constructions as in the first embodiment of the reclosable-tape-having bag 1 may be omitted.

Figure 14:
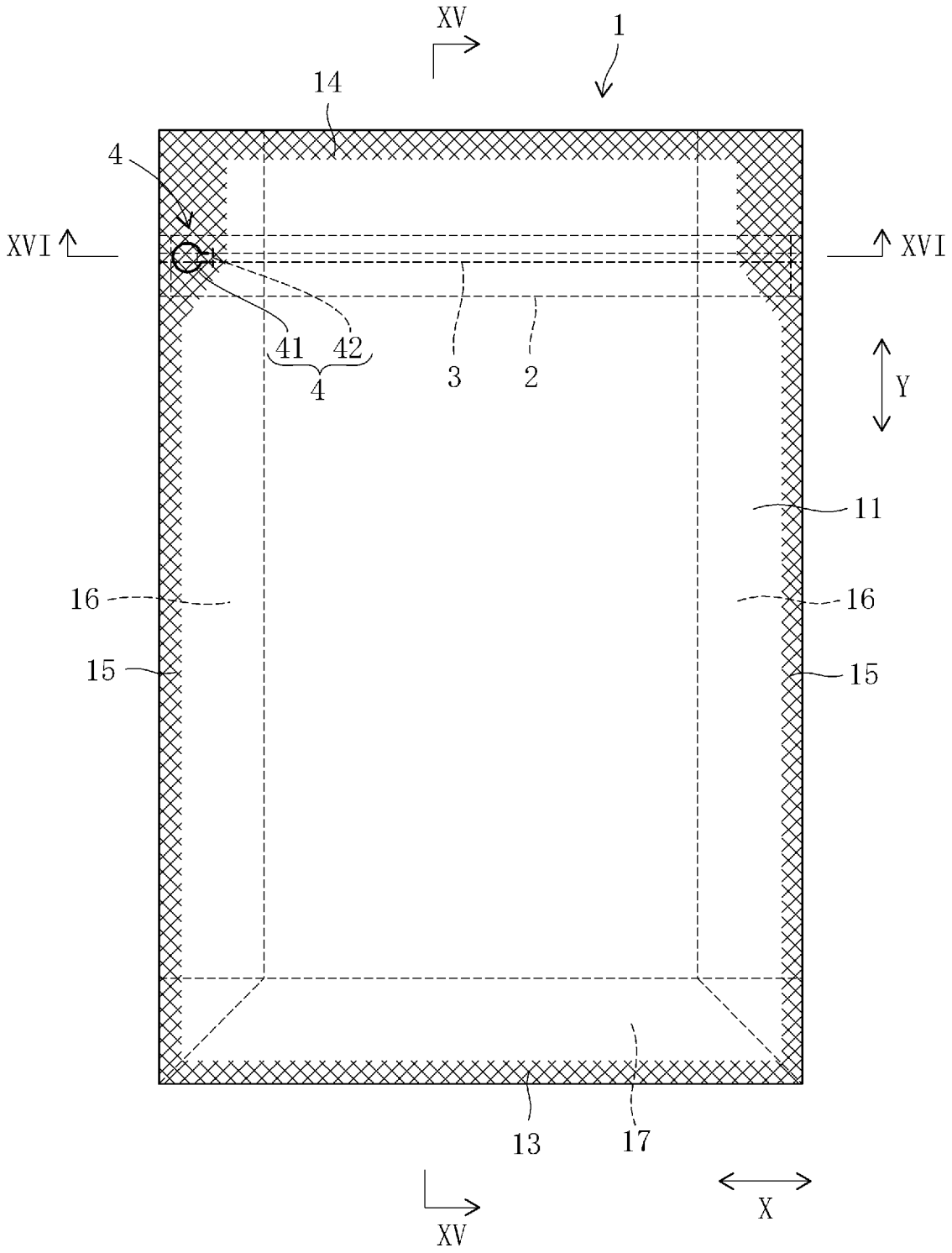
FIG. 14 is a front view showing a second embodiment of the reclosable-tape-having bag.
Figure 15:
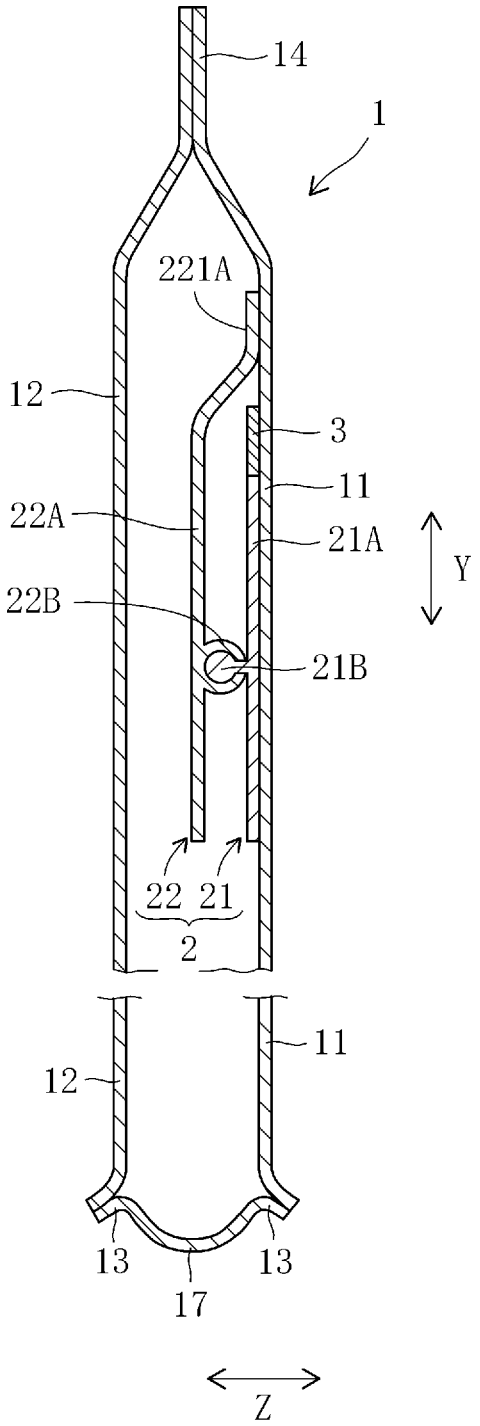
FIG. 15 is a partially cross-sectional view taken along line XV-XV in FIG. 14.
Figure 16:
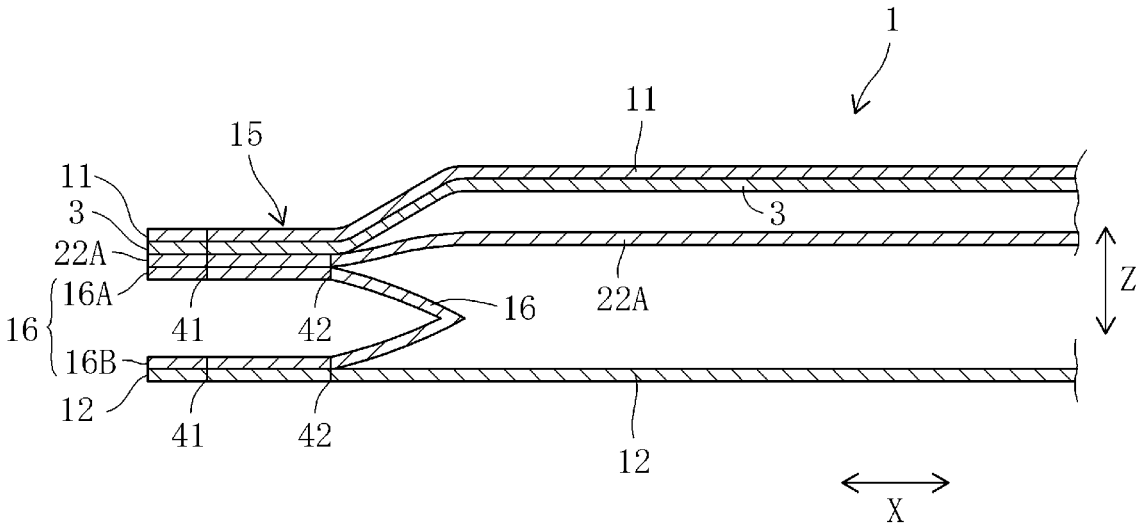
FIG. 16 is a partially cross-sectional view taken along line XVI-XVI in FIG. 14.

As shown in FIGS. 14 to 16, the bag 1 includes a pair of side gusset materials 16 and 16 and a bottom material 17 so as to contain a large amount of the articles. As shown in FIG. 16, the side gusset materials 16 include first and second gusset portions 16A and 16B. The first gusset portion 16A is disposed on a side of the first panel material 11, while the second gusset portion 16B is disposed on a side of the second panel material 12.

As shown in FIG. 16, the punched portion 41 is formed by punching the first panel portion 11, the second panel portion 12, the open tape 3, the side gusset materials 16 and the mounting base portion 22A of the male fastener portion 22. On the other hand, the incised portion 42 is formed by incising the second panel material 12, the side gusset materials 16 and the mounting base portion 22A disposed on the open tape 3 and by not incising the first panel material 11 and the open tape 3.

Figure 17:
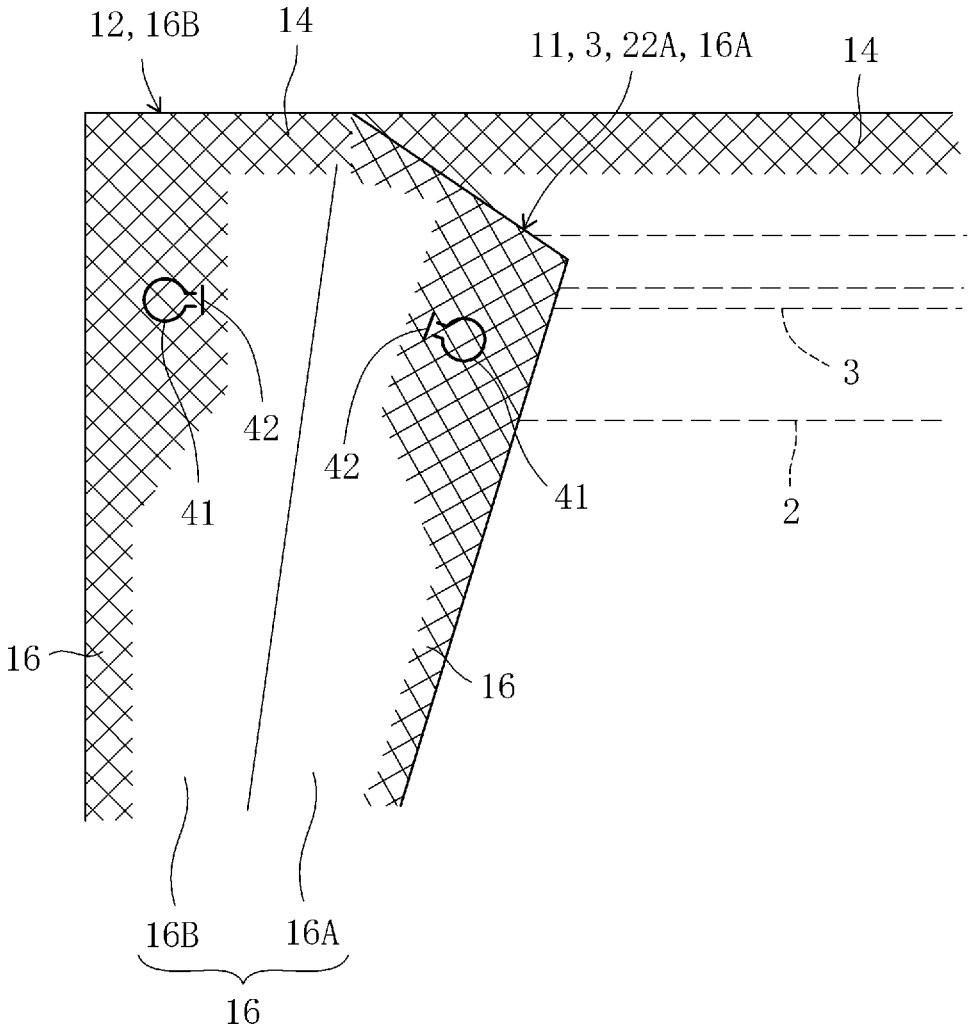
FIG. 17 is a partially enlarged view showing the second embodiment of the reclosable-tape-having bag, in which a side gusset material is opened.

As shown in FIG. 17, the punched portion 41 and the incised portion 42 are punched through the second panel material 12 and the second gusset portion 16B. There is no problem in this embodiment because the punched portion 41 is not contact with the incised portion 42. However, if the punched portion 41 is contact with the incised portion 42, this portion can be divided from the second panel material 12 so as to become a chip and may be mixed into the bag 1. Therefore, the punched portion 41 should be non-contact with the incised portion 42.

As described above, preferred embodiments of the present invention are explained. However, the constructions of the present invention are not limited to the embodiments. The constructions of the present invention may be changed and modified as follows.

- The punching blade 50 may be movable, and the incising blade 51 may be immovable.
- The adjusting mechanism 54 may be constituted of a hydraulic or electric actuator.
- The pressing portion 58 may be constituted of a coiled spring, a disc spring and so on.
- The switching portion 55 may be constituted of a pin capable of being engaged with and separated from the bolt 540, a chuck capable of being clumped with and separated from the bolt 540, and so on.
- The rails 500 may be mounted on the supporting portion 52 and so on.

The effect of the present invention will be explained.

(1) The punching unit 5 and the manufacturing apparatus 100 of the present invention include the adjusting mechanism 54 for adjusting the first gap 56 between the edges 50A and 51A of the punching and incising blades 50 and 51 in the punching direction 5Z. Thus, the punched and incised portions 41 and 42 are formed properly, in which it is not necessary to replace the anvil 5A depending on the type of the sheet material.

(2) The adjusting mechanism 54 is configured to adjust the first gap 56 by the rotation of the bolt 540. Thus, the adjusting mechanism 54 is excellent in productivity and management because complex construction and control are not needed for adjusting. Further, an operator can adjust the first gap 56 easily only by the rotation of the bolt 540.

(3) The adjusting mechanism 54 includes the pressing portion 58 so that the punching blade 50 or the incising blade 51 abuts against the bolt 540. Thus, the adjusting mechanism 54 can adjust the punching blade 50 or the incising blade 51 with certainty because the punching blade 50 or the incising blade 51 is constantly contact with the bolt 540.

(4) The bolt 540 includes the knob 541 having a scale 541A for indicating the amount of the rotation of the bolt 540. Thus, an operator can adjust and readjust the bolt 540 easily and certainly.

(5) The adjusting mechanism 54 includes the switching portion 55 for switching between the movable and immovable states of the rotation of the bolt 540. Thus, the switching portion 55 can prevent the rotation of the bolt 540 caused by the vibration of the manufacturing apparatus and so on.

(6) The incising blade 51 can move relative to the punching blade 50 by the adjusting mechanism 54. It is preferable that the punching blade 50 is held so as to be immovable because the force applied to the punching blade 50 is large when forming the tab 4.

(7) The adjusting mechanism 54 includes the rails 500 for sliding the incising blade 51 relative to the punching blade 50. Thus, the rails 500 can prevent the edge 51A of the incising blade 51 from being inclined relative to the second panel material 12 and so on when moving the incising blade 51.

(8) The rails 500 are mounted on the punching blade 50 or the incising blade 51. As a result, both directions of the edges 50A and 51A of the punching and incising blades 50 and 51 are constantly parallel to each other so that the punched and incised portions 41 and 42 can be formed exactly and certainly.

(9) The punching unit 5 has the second gap 57 in the direction 5X right-angled to the punching direction 5Z between the edges 50A and 51A of the punching and incising blades 50 and 51. Therefore, the punched portion 41 is non-contact with the incised portion 42 so as not to form the chip even in the bag 1 having the side gusset materials 16.

DESCRIPTION OF THE REFERENCE CHARACTERS

1: reclosable-tape-having bag
11: first panel material
12: second panel material
2: reclosable tap
21: male fastener portion
21A: mounting base portion of the male fastener portion
22: female fastener portion
22A: mounting base portion of the female fastener portion
3: open tape
4: tab
41: punching portion
42: incising portion
5: punching unit
50: punching blade
50A: edge of the punching blade
51: incising blade
51A: edge of the incising blade
54: adjusting mechanism
540: bolt
541: knob
541A: scale
55: switching portion
56: first gap
57: second gap
58: pressing portion
500: rail
5Z: punching direction
5X: direction right-angled to the punching direction

What is claimed is:

1. A punching unit for forming a tab on a reclosable-tape-having bag, wherein:

the bag comprises:

a first panel material;

a second panel material superposed on the first panel material, the first and second panel materials being attached together at peripheries thereof;

a reclosable tape disposed between the first and second panel materials, the reclosable tape including male and female fastener portions; and an open tape disposed between a mounting base portion of the male or female fastener portion and the first panel material so as to rip off the first panel material, and the punching unit comprises:

a punching blade configured to punch the first panel material, the second panel material, the open tape and the mounting base material so as to form a punched portion;

an incising blade configured to incise the second panel material and the mounting base portion disposed on the open tape so as to form an incised portion; and an adjusting mechanism configured to adjust a first gap disposed in a punching direction and between edges of the punching and incising blades, wherein:

the adjusting mechanism comprises a bolt configured to press the punching or incising blade to adjust the first gap by rotating the bolt, the bolt comprises a knob for rotating the bolt, and the knob comprises a scale for indicating an amount of a rotation of the bolt as an indicator of an amount of adjustment of the first gap made by rotating the bolt with the knob.

2. The punching unit as set forth in claim 1, wherein the adjusting mechanism comprises a press portion for pressing and abutting the punching or incising blade against the bolt.

3. The punching unit as set forth in claim 1, wherein the adjusting mechanism is configured to move the incising blade relative to the punching blade.

4. The punching unit as set forth in claim 3, wherein the adjusting mechanism comprises a rail for sliding the incising blade relative to the punching blade.

5. The punching unit as set forth in claim 4, wherein the rail is mounted on the punching or incising blade.

6. The punching unit as set forth in claim 1, wherein:

the punching blade is configured to punch the first panel material, the second panel material, the open tape and the mounting base material so as to form the punched portion while the first and second panel materials are stopped; and the incising blade is configured to incise the second panel material and the mounting base portion disposed on the open tape so as to form the incised portion while the first and second panel materials are stopped.

7. The punching unit as set forth in claim 6, further comprising an elastic portion configured to press the second panel material when the punching and incising blades move from a punching position to a standby position.

8. The punching unit as set forth in claim 1, wherein the punching blade and the incising blade are located on a side of the bag facing the second panel material, the punching unit further comprising an anvil located on an opposite side of the bag facing the first panel material, the anvil including a substantially flat surface facing the first panel material.

9. The punching unit as set forth in claim 1, further comprising a switching unit located on the adjusting mechanism and configured to switch the bolt between movable and immovable states.

10. The punching unit as set forth in claim 1, further comprising an adjusting mark located adjacent to the scale on the knob, and configured to facilitate micro adjustments of the bolt by the knob based on positional relations of the scale and the adjusting mark.

11. A manufacturing apparatus for manufacturing a reclosable-tape-having bag, the manufacturing apparatus comprising a tab forming portion, wherein:

the bag comprises:

a first panel material;

a second panel material superposed on the first panel material, the first and second panel materials being attached together at peripheries thereof;

a reclosable tape disposed between the first and second panel materials, the reclosable tape including male and female fastener portions; and an open tape disposed between a mounting base portion of the male or female fastener portion and the first panel material so as to rip off the first panel material, and tab forming portion includes a punching unit comprising:

a punching blade configured to punch the first panel material, the second panel material, the open tape and the mounting base material so as to form a punched portion;

an incising blade configured to incise the second panel material and the mounting base portion disposed on the open tape so as to form an incised portion; and an adjusting mechanism configured to adjust a first gap disposed in a punching direction and between edges of the punching and incising blades, wherein:

the adjusting mechanism comprises a bolt configured to press the punching or incising blade to adjust the first gap by rotating the bolt, the bolt comprises a knob for rotating the bolt, and the knob comprises a scale for indicating an amount of a rotation of the bolt as an indicator of an amount of adjustment of the first gap made by rotating the bolt with the knob.

12. The manufacturing apparatus of claim 11, further comprising a guide portion including a pair of guide rollers configured to receive the first and second panel materials, wherein the first and second panel materials are superimposed with each other by the pair of guide rollers.

13. The manufacturing apparatus of claim 11, wherein:

the punching blade is configured to punch the first panel material, the second panel material, the open tape and the mounting base material so as to form the punched portion while the first and second panel materials are stopped; and the incising blade is configured to incise the second panel material and the mounting base portion disposed on the open tape so as to form the incised portion while the first and second panel materials are stopped.

14. The manufacturing apparatus of claim 11, further comprising an elastic portion configured to press the second panel material when the punching and incising blades move from a punching position to a standby position.

15. The manufacturing apparatus of claim 11, wherein the punching blade and the incising blade are located on a side of the bag facing the second panel material, the punching unit further comprising an anvil located on an opposite side of the bag facing the first panel material, the anvil including a substantially flat surface facing the first panel material.

16. The manufacturing apparatus of claim 11, further comprising a switching unit located on the adjusting mechanism and configured to switch the bolt between movable and immovable states.

17. The manufacturing apparatus of claim 11, further comprising an adjusting mark located adjacent to the scale on the knob, and configured to facilitate micro adjustments of the bolt by the knob based on positional relations of the scale and the adjusting mark.

18. The manufacturing apparatus of claim 11, wherein the adjusting mechanism is configured to move the incising blade relative to the punching blade.

19. The manufacturing apparatus of claim 18, wherein the adjusting mechanism comprises a rail for sliding the incising blade relative to the punching blade.

20. The manufacturing apparatus of claim 19, wherein the rail is mounted on the punching or incising blade.

* * * * *